United States Patent [19]

Müllner et al.

[11] Patent Number: 4,707,222

[45] Date of Patent: Nov. 17, 1987

[54] START-UP AND OPERATING PROCEDURE FOR ROLL PRESS HAVING AN EXTENDED NIP PRESS WITH INFLATABLE PRESS JACKET

[75] Inventors: Josef Müllner; Christian Schiel, both of Heidenheim; Karl Steiner, Herbrechtingen, all of Fed. Rep. of Germany

[73] Assignee: J. M. Voith GmbH, Fed. Rep. of Germany

[21] Appl. No.: 716,836

[22] Filed: Mar. 28, 1985

[30] Foreign Application Priority Data

Feb. 1, 1985 [DE] Fed. Rep. of Germany ..... 3503373

[51] Int. Cl.[4] ..... D21F 3/08

[52] U.S. Cl. ..... 162/205; 100/48; 100/121; 100/211; 162/358; 162/262; 162/199

[58] Field of Search ..... 162/358, 205, 361, 199, 162/272, 262; 29/116 AD, 113 AD; 100/37, 48, 121, 211

[56] References Cited

U.S. PATENT DOCUMENTS 3,269,893 8/1966 Rojecki ..... 162/358
3,804,707 4/1974 Mohr et al. ..... 29/113 AD
4,555,305 11/1985 Steiner et al. ..... 162/205
4,563,245 1/1986 Caapotti ..... 162/358
4,576,682 3/1986 Wanke et al. ..... 162/358

FOREIGN PATENT DOCUMENTS 3317457 11/1984 Fed. Rep. of Germany ..... 162/358

*Primary Examiner*—S. Leon Bashore
*Assistant Examiner*—K. M. Hastings
*Attorney, Agent, or Firm*—Ostrolenk, Faber, Gerb & Soffen

[57] ABSTRACT

In an extended nip press including a stationary support member, a hydraulically actuatable press shoe supported on and extending along the support member and a rotatable counter-roll opposed to and extending along the direction of the press shoe, there is a flexible, tubular press jacket which rotates around the support member and which is sealed so as to be inflatable by air. Before rotation of the counter-roll starts, the press jacket is air inflated and expands to partially wrap around the counte-roll. After rotation of the counter-roll and the press jacket begins, and only after a set minimum velocity has been exceeded, then the press shoe is fluid pressurized against the press jacket. At the time, the air pressure in the press jacket is reduced. Various control devices control the feed of pressure liquid to the press shoe and the feed of air to the press jacket until and then after a minimum speed level is exceeded.

3 Claims, 1 Drawing Figure

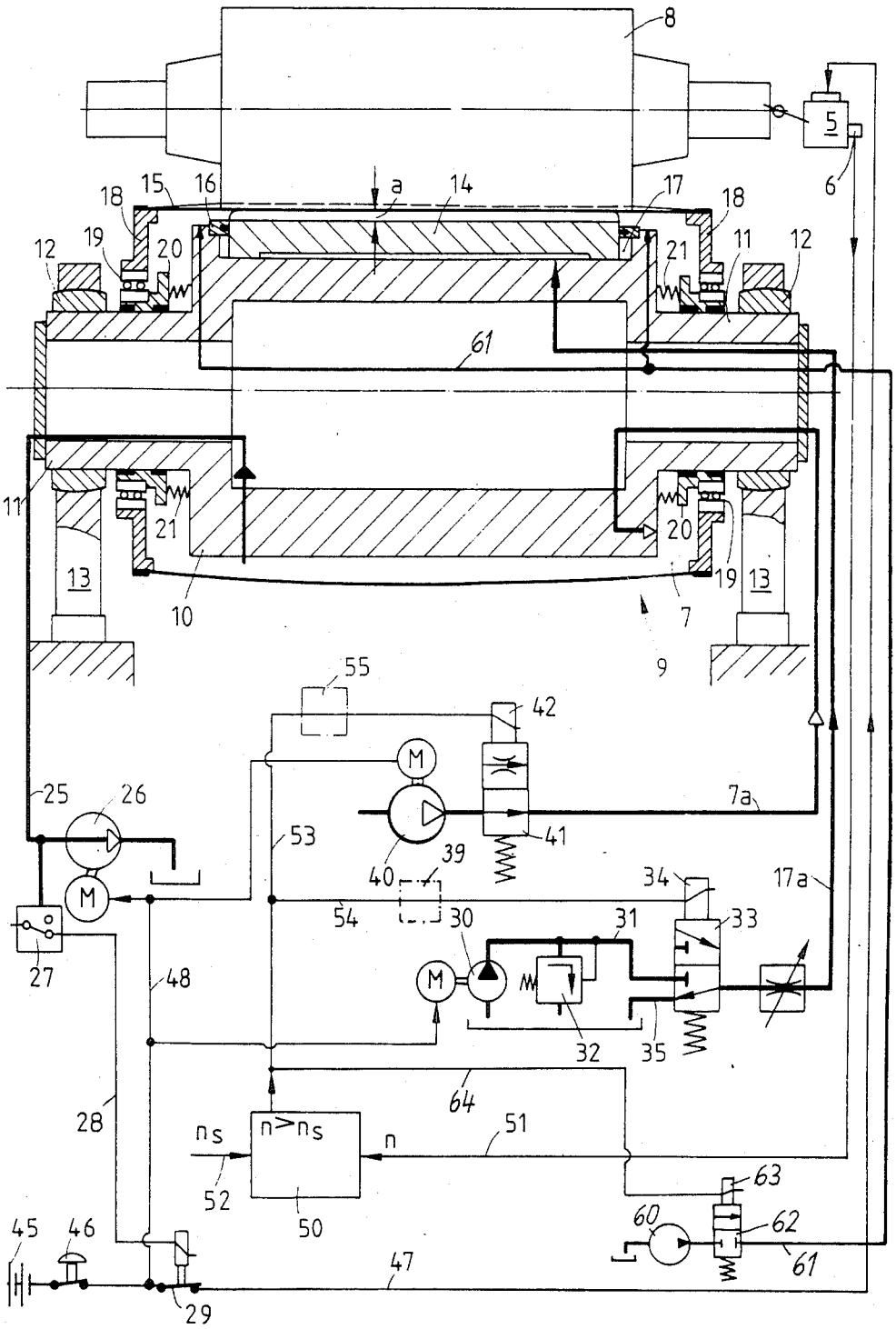
8
5
6
a
14
15
16
17
18
19
20
21
11
12
61
13
10
7
9
55
42
M
7a
25
26
53
41
40
39
34
17a
54
30
31
33
27
48
32
35
64
28
ns
n>ns
n
51
52
50
63
60
62
45
46
47
29

START-UP AND OPERATING PROCEDURE FOR ROLL PRESS HAVING AN EXTENDED NIP PRESS WITH INFLATABLE PRESS JACKET

BACKGROUND OF THE INVENTION

The invention relates to a roll press having an extended nip press. Such a roll press is shown, for instance, in Federal Republic of Germany DE-OS 33 11 996 (U.S. Pat. No. 4,555,305). It can preferably be used as the water-removal press in a paper making machine. The present invention concerns the control over the feeding of pressurized fluid for pressurizing the the press shoe, the inflation of the press jacket and removal of the lubricating fluid from inside the enclosure defined by the press jacket.

An extended nip press includes a stationary support member and a flexible, tubular, inflatable press jacket or shell which can be revolved around the support member. A hydraulically actuatable press shoe is supported on the stationary support member in opposition to a counter-roll, and the press shoe is pressed against the inside of the press jacket toward the press roll to press between them the fiber web being dewatered, and a dewatering felt web. There is a feed for liquid pressure to the press shoe for urging it outwardly toward the counter-roll. There is also a feed of compressed air into the interior space surrounded by the press jacket for inflating the press jacket. The press shoe and the counter-roll of this roll press together form a press nip which is not a line nip, but which is instead relatively long in the direction of rotation, i.e. an extended press nip.

The above German Application describes that the press jacket of the extended nip press is indirectly driven merely by a felt belt, which, together with the web of paper from which the water is to be removed, travels through the press nip of the roll press. The felt belt is preferably driven by the counter-roll of the press. However, the drive can be effected by another roll over which the felt belt travels.

Furthermore, the German Application describes measures for facilitating starting the roll press from standstill by providing the greatest possible reduction in its starting torque. For this purpose, compressed air is blown into the press jacket. This holds the press jacket a certain distance from the support member so that it cannot stick to the support member. Such sticking can be caused, inter alia, by the lubricant which is fed to the inside of the press jacket.

No further information is given in the German Application concerning the control of the feed of pressure liquid for actuating the press shoe. However, it is evident that the pressing pressure within the press nip can be varied by adjusting the pressure of the liquid which acts on the press shoe.

The above-described known roll press has proven its worth in practical use. However, further improvements are desirable in order, on the one hand, to still further reduce the drive energy necessary for starting the roll press and, on the other hand, to make the starting process more reliable, so that the operator need perform as few switching operations as possible.

SUMMARY OF THE INVENTION

According to the invention, there is a first control device for controlling the feed of compressed air into the interior space surrounded by the press jacket for inflating the press jacket at least during the start of the drive and rotation of the counter-roll. This is particularly important since at the start of the motion of the counter-roll and the press jacket, the press jacket is not adequately lubricated at its interior as it passes over the press shoe. There is also a second control device which controls the feeding of the pressurized liquid for actuating the press shoe to press against the interior of the press jacket. The second control device for the pressure liquid operates so that during starting of the drive by the counter-roll and until a minimum speed of the counter-roll has been achieved, the second control device reduces or blocks the feed of pressurizing liquid to the press shoe. This keeps the press shoe out of pressing action against the press jacket. The second control device permits the feed of pressurizing liquid to the press shoe only after that minimum speed has been exceeded.

It has been found that upon connecting the drive of the counter-roll, the press jacket of the extended nip press can be placed in operation particularly easily if the liquid pressure acting on the press shoe is equal to or only slightly greater than zero. In this way, the initial contact between the press jacket and the dewatering felt belt which travels around the counter-roll is produced solely by the inflation of the press jacket, and the press jacket is driven by the counter-roll. The drive power necessary for this is very slight, since only slight or even no frictional forces occur between the press jacket and the press shoe, in contrast to normal operation. This is true even in the relatively unfavorable case in which the extended nip press roll is arranged below the counter-roll and the press shoe is thus in the upper region of the extended nip press roll. In this case, the press jacket at most contacts the edge regions of the press shoe, i.e. it is not in contact with the entire travel surface of the press shoe.

However, it has been found that under certain conditions, particularly if the extended nip press roll is arranged below the counter-roll, the starting of the inflated press jacket without its acting on the press shoe is not sufficient in itself to assure dependable operation of the roll press. Experiments have shown unexpectedly that if the press shoe presses the press belt against the counter-roll while the press jacket is still inflated, then the drive power required is greater than average. Apparently, the travel surface of the press shoe is not sufficiently lubricated in this state, i.e. the press jacket has not transported sufficient lubricant into the nip between the press shoe and the press jacket. For this reason, the invention further provides that, simultaneously with or shortly after the start of the action of pressure liquid on the press shoe, the air pressure within the press jacket, which has served for inflating the jacket, is reduced substantially or completely to atmospheric pressure. Reducing the air pressure within the press jacket after the action on the press shoe makes it possible to maintain the drive power at the normal level.

The above-described reduction of the feed of compressed air into the press jacket simultaneously with or shortly after the starting of the feed of pressure liquid to the press shoe can advantageously be made automatic in accordance with an appropriate starting-switch means. That starting-switch means comprises a comparator which compares a measurement of the speed of rotation of the counter-roll with a reference variable which corresponds to a minimum speed of rotation. Once the instantaneous speed of rotation exceeds the minimum speed, the above-described reduction of feed of air following the starting of the feed of liquid can occur.

There is also a suction device for drawing lubricating or cooling liquid out of the interior space surrounded by the press jacket. Connection of the drive for rotation of the counter-roll is blocked as long as the vacuum in the suction device is present, which means that it is still suctioning liquid out of the interior of the press jacket. This embodiment takes into account the fact that while the roll press is at a standstill, a large quantity of lubricating or cooling liquid may possibly collect within the press jacket. The weight of this amount of liquid acts on the press jacket and impedes it during starting. This is particularly true when the press shoe is arranged in the upper region of the extended nip press roll. This arrangement assures that before the connection of the drive of the counter-roll, at least the greatest part of the lubricating or cooling liquid has been drawn out from inside the press jacket. During this withdrawal process, a vacuum is established in the suction device, upon which the connection of the drive of the counter-roll is still blocked. After the substantial or complete emptying by suction of the press jacket, the vacuum collapses, i.e. the pressure in the suction device increases to close to atmospheric pressure. In this way, a signal is formed which establishes the connecting of the drive of the counter-roll.

There is additionally a feed device for feeding lubricating or cooling liquid to the inside of the press jacket with an additional control device that opens for the feed of lubricating or cooling liquid substantially only when the minimum speed of rotation of the counter-roll has been exceeded. This takes into account that the paper machine, and thus also the roll press, may have to operate for a long period of time at a slow, creeping speed. This means that for a long period of time the press jacket rotates according to the invention solely due to the inflation of the press jacket against the counter-roll and without action on the press shoe, since the creep speed is far less than the minimum normal speed, during which the press shoe is active. During operation at creep speed, the above-stated measure assures that the feeding of lubricating or cooling liquid to the inside of the press jacket, which in normal operation serves for lubricating the slide surfaces contacted by the press jacket and for cooling the press jacket, is throttled or entirely blocked off. Otherwise, there is the danger that, despite the prior drawing off of the liquid, a large amount of liquid will collect in the sump, i.e. in the inner space enclosed by the press jacket, and impede the rotation of the press jacket. The small amount of liquid which always remains in the sump is sufficient for the lubrication of the press jacket as it is moving at creep speed.

BRIEF DESCRIPTION OF THE DRAWING

An embodiment of the invention is described below with reference to the drawing, which in diagrammatic form shows an extended nip press roll in longitudinal section, as well as the corresponding counter-roll and the essential drive and control parts.

DESCRIPTION OF THE PREFERRED EMBODIMENT

The extended nip press roll 9 includes a non-rotatable, stationary support member 10 which has a respective hollow journal 11 at each of its two ends. These journals are supported by spherical bushings 12 in machine frames 13. A press shoe 14 is arranged in a recess 17 in the support member 10. The press shoe forms an extended area, extended press nip in known manner with a counter-roll 8. A flexible liquid-tight press jacket 15 surrounds the support member 10 and passes through the nip. A felt belt (not shown) travels in known manner through the press nip with the web of paper (not shown) which is supported by the felt belt and from which the water is removed in the press zone. The support member 10 has a seal 16 which extends around the periphery of the press shoe 14. Feeding a pressure fluid via the line **17*a* into the recess 17 causes the press shoe 14 to press the press jacket 15 against the counter-roll 8. In the condition shown, however, the recess 17 is not pressurized so that the press shoe 14** is seated on the bottom of the recess.

Each of the two lateral ends of the press jacket 15 is clamped in a rotatable disk 18. The disk is mounted by an anti-friction bearing 19 on a mounting ring 20, which is seated in an axially displaceable but non-rotatable manner on the journal 11.

The press jacket 15 is axially tensioned by compression springs 21. Sealing rings (not shown) are arranged alongside the anti-friction bearings 19. Those rings close off the inner space 7, which is surrounded by the press jacket 15 and the disks 18, from the outside. This enables the press jacket 15 to be inflated by feeding compressed air through the line **7*a* into the interior 7 of the press jacket 15. The press jacket 15 wraps for a circumferential distance around the counter-roll 8, partially under the influence of the pressure of the compressed air and partially due to the axial tensioning by the springs 21. This wrapping is effected without lifting the press shoe 14**.

For cooling the press jacket 15 and for lubricating the slide surface of the press shoe 14 over which the press jacket 15 travels when the press shoe 14 is acted on by fluid pressure behind it with a recess 17, the inside of the press jacket 15 is fed cooled lubricating oil in known manner. For this purpose, a pump 60, a lubricating oil line 61 and, within it, a control valve 62 with an electromagnet 63 are provided. Differing from what has been shown in the drawing, the lubricating oil is fed into the press jacket 15 not only at the ends of the roll 9, but it is also, in accordance with the aforementioned German DE-OS, distributed uniformly over the width of the machine. As shown in the drawing, the control valve 62 is closed in its position of rest and is opened in the operating position when the electromagnet 63 is energized.

The lubricating oil which collects in the lower region of the inner space 7 is discharged via a suction line 25 and a suction pump 26. A pressure switch 27 is connected to the suction line 25. The switch 27 is in the position shown when no substantial vacuum is present in the suction line 25, and this gives off an electric signal to the control line 28. In this way, a relay 29 is closed.

For feeding pressure liquid into the recess 17, for acting upon the press shoe 14, a pump 30 is provided having a delivery line 31 to which an overflow valve 32 is connected in a customary manner. A control valve 33 can be switched from the position of rest shown into an operating position by means of an electromagnet 34. The valve connects the line **17*a* leading to the recess 17 to an evacuation line 35 in the position of rest and to the delivery line 31**, on the other hand, in the operating position.

For inflating the press jacket 15, i.e. for feeding compressed air into the inner space 7, an air pump 40 is provided. Its delivery side is connected, via a switch valve 41, to the line *7a*. In the position of rest shown, the switch valve 41 connects the delivery side of the air pump unthrottled to the line *7a*. By means of an electromagnet 42, the valve 41 can be switched into an operating position in which the connection is throttled, so that the pressure prevailing in the interior 7 of the jacket is substantially reduced as compared with its previous level.

A source of electric current 45 is connected, via a main switch 46 and the aforementioned relay 29, to a main line 47 which serves to feed current to an electric motor 5 which drives the counter-roll 8. Between the main switch 46 and the relay 29, a line 48 branches off from the main line 47 for supplying current to the drive motors M of the pumps 26, 30 and 40.

A measurement variable for the instantaneous speed of rotation n, and thus for the circumferential speed of the counter-roll 8 and of the press jacket 15, is fed to a comparator 50 via a measurement line 51 from a speed-of-rotation meter 6 which is arranged on the drive motor 5. The comparator 50 also receives, via a line 52, a reference variable which corresponds to the desired minimum speed of rotation $n_s$ and thus to the minimum circumferential speed of the press jacket 15. If the instantaneous speed of rotation n should, during starting, exceed the minimum speed of rotation $n_s$, then the comparator gives off a control signal as the result of which the electromagnets 34, 42 and 63 are energized via the lines 53, 54 and 64, respectively, and the switch valves 33, 41 and 62, respectively, are thus switched into their operating positions.

The extended nip press is started by closing the main switch 46. Since the relay 29 is initially still open, only the pumps 26, 30 and 40 are thereby placed in operation. In this way, any lubricating oil present in the interior 7 is drawn out. Furthermore, the press jacket 15 is inflated. As a result, the press jacket comes against the counter-roll 14 and wraps around the latter for a circumferential distance. The press shoe is not acted upon, since the switch valve 33 is in the position of rest. Thus, initially, a free space a remains between the concave slide surface of the press shoe and the interior of the press jacket. The proper size of this space a must be determined by experiment before the initial starting by varying the distance between the axes of the two press rolls 8 and 9.

After the lubricating oil has been drawn out of the jacket, the vacuum in the line 25 collapses, and then the pressure switch 27 causes closing of the relay 29. In this way, the counter-roll 8 is placed in rotation. It carries the press jacket 15 along with it via the felt belt, not shown. If necessary, one can operate in this condition with creep speed for a relatively long period of time. When, however, the roller 8 has been accelerated and the desired minimum speed has been reached, then the comparator 50, as described above, brings about the switching of valves 33, 41 and 62, so that the feed of lubricating oil commences, the press shoe 14 is acted upon and the air pressure in the interior 7 is reduced.

Operation of the roll press is thereafter maintained with the air pressure reduced in the interior 7 of the jacket.

If necessary, the switching of the valve 33 can be delayed in time with respect to the switching of the valve 62 by means of a time switch member 39. In exactly the same way, the switching of the valve 41 can be delayed in time with respect to the switching of the valve 33 by means of a time switch member 55. In another variant, the valve 41 can, in the operating position, completely interrupt the connection from the pump 40 to the line *7a*.

In the embodiment shown, the counter-roll 8 is arranged above the extended nip press roll 9. However, other arrangements are possible. In this connection, it is possible to dispense with that coupling of the electromagnets 34 and 42 of the two switch valves 33 and 41 which is shown in the drawing.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A method of starting and maintaining the operation of a roll press of an extended nip press, wherein the roll press includes a stationary support member, a press shoe which is supported in a fluid pressure chamber which is pressurized with liquid to urge the press shoe toward a cooperating counter-roll and a tubular, sealed, inflatable press jacket which rotates over the stationary support member and the press shoe and which rotates along with the counter-roll that is opposed to the press shoe, the method comprising:

(a) feeding compressed air into the interior space surrounded by the press jacket for inflating the press jacket to partially wrap around the counter-roll at least during the starting of the drive and rotation of the counter-roll;

(b) rotating the counter-roll to rotate the press jacket which is partially wrapped around the counter-roll;

(c) withholding the feed of pressurized liquid to the pressure chamber behind the press shoe so that the press shoe does not press the press jacket toward the counter-roll until a minimum speed of rotation of the counter-roll has been exceeded;

(d) thereafter feeding pressurizing liquid to the pressure chamber behind the press shoe once the minimum speed of rotation of the counter-roll has been exceeded; and (e) reducing the feed of compressed air into the interior space with the commencement of feeding of the pressure liquid to the pressure chamber behind the press shoe; and (f) maintaining operation of said roll press with said reduced feed of compressed air into the interior space.

2. The method of claim 1, further comprising feeding lubricating liquid to the press jacket for lubricating its passage over the press shoe after a minimum speed of rotation of the counter-roll is exceeded.

3. The method of claim 2, further comprising before starting the counter-roll to rotate, suctioning said liquid from said interior space within the press jacket.

* * * * *